US007726506B2

(12) United States Patent
Reutter

(10) Patent No.: US 7,726,506 B2
(45) Date of Patent: Jun. 1, 2010

(54) CONTAINER CLOSURE AND CLOSURE LID FOR SAID CONTAINER CLOSURE

(76) Inventor: Heinrich Reutter, Theodor-Heuss-Strasse 12, 71336 Waiblingen (DE)

( * ) Notice: Subject to any disclaimer, the term of this patent is extended or adjusted under 35 U.S.C. 154(b) by 1463 days.

(21) Appl. No.: 10/468,400

(22) PCT Filed: Apr. 30, 2002

(86) PCT No.: PCT/EP02/04741

§ 371 (c)(1),
(2), (4) Date: Aug. 29, 2003

(87) PCT Pub. No.: WO02/090202

PCT Pub. Date: Nov. 14, 2002

(65) Prior Publication Data

US 2004/0069784 A1 Apr. 15, 2004

(30) Foreign Application Priority Data

May 4, 2001 (DE) ..... 201 07 582 U

(51) Int. Cl.
*B65D 53/02* (2006.01)
*B65D 51/16* (2006.01)

(52) U.S. Cl. ..... 220/304; 220/203.12; 220/378; 220/303

(58) Field of Classification Search ..... 220/304, 220/303, 203.12, 203.13, 203.29, 240, 378, 220/366.1; 277/311, 625
See application file for complete search history.

(56) References Cited

U.S. PATENT DOCUMENTS 2,614,793 A * 10/1952 Storm ..... 137/860
3,359,999 A * 12/1967 Mueller ..... 137/246.15
3,497,395 A * 2/1970 Kohen ..... 429/55
4,146,147 A * 3/1979 Sloan, Jr. ..... 220/203.26
4,241,845 A 12/1980 Daly et al.
4,577,870 A * 3/1986 Scott et al. ..... 277/311
4,673,000 A * 6/1987 Haerr et al. ..... 137/860
5,127,804 A * 7/1992 Chappell ..... 417/231
5,829,620 A 11/1998 Harris et al.
5,839,765 A * 11/1998 Carter et al. ..... 285/334.2

(Continued)

FOREIGN PATENT DOCUMENTS

DE 299 18 541 U1 3/2000

(Continued)

*Primary Examiner*—Anthony Stashick
*Assistant Examiner*—Niki M Eloshway
(74) *Attorney, Agent, or Firm*—Bacon & Thomas

(57) ABSTRACT

A closure lid for a connecting element of a computer container, comprising an inner part which is maintained on an outer part of said lid and which is provided with an annular groove on the outer periphery thereof, said groove being defined by an annular web on the outer side of the lid and having a sealing ring inserted therein. In order to provide a closure lid which is embodied in such a way that it is possible to prevent the sealing ring from being raised radially from the base of the groove as a result of existing pressure and therefore to relieve the pressure inside the container before the open position of the closure container is reached, the annular web disposed on the outer side of the lid is provided with an uneven bearing surface for the sealing ring.

11 Claims, 5 Drawing Sheets

U.S. PATENT DOCUMENTS

| | | | | |
|---|---|---|---|---|
| 5,941,537 | A * | 8/1999 | Wallace et al. | 277/642 |
| 5,971,285 | A * | 10/1999 | Knapp | 236/12.2 |
| 6,056,139 | A | 5/2000 | Gericke | |
| 6,461,557 | B1 * | 10/2002 | Boast et al. | 264/257 |

FOREIGN PATENT DOCUMENTS

| | | |
|---|---|---|
| DE | 199 46 845 A1 | 4/2001 |
| DE | 100 51 444 A1 | 5/2001 |

* cited by examiner

CONTAINER CLOSURE AND CLOSURE LID FOR SAID CONTAINER CLOSURE

FIELD OF THE INVENTION

The present invention relates to a closure lid for the container neck of a container closure having an inner part that is retained on an outer part provided on its outer circumference with an annular groove defined by an annular rib toward the outer part, and into which a sealing ring is inserted; and a container closure having such a closure lid which is movable between an open position, in which it can be removed from the container neck and a closing position in which it is moved axially with its inner part into the container neck, and the inner part is provided on the outside with an annular groove defined by an annular rib toward the lid and into which a sealing ring is inserted. The container neck at the level of the sealing ring, when the closure lid is in the closing position, has a sealing face on which the sealing ring rests sealingly, and when the closure lid is in a position between the closing and open positions, has a radial neck enlargement for generating a pressure relief gap between the sealing ring and neck enlargement; and the pressure relief gap, via a pressure relief chamber, is in communication with the ambient atmosphere.

BACKGROUND OF THE INVENTION

One such container closure, and one such closure lid for the container neck of a container closure, are known from German Utility Model DE-U 299 28 541. This reference also describes how such container closures and closure lids are inserted, in order to seal off the container in the closing position of the closure lid, or upon rotation of the closure lid in the opening direction before the closure lid is finally released or removed from the container neck, to achieve a pressure relief on the basis of the still existing overpressure in the container interior, so that liftoff of the closure lid from pressure, which risks a burn injury from hot coolant as it shoots out, can be avoided.

In this prior art, one phenomenon of conventional container closures or closure lids, known as the champagne cork effect, is also described. In it, if the closure lid comes loose from the container neck, at elevated internal pressures, despite the radially inward-oriented tension that intrinsically presses the sealing ring against the annular groove, the sealing ring can still remain in contact with the inner wall of the container neck, if the sealing ring comes out of the region of the sealing face into the region of the neck enlargement, in the unscrewing direction of the closure lid. In other words, in this phenomenon, the sealing ring is lifted radially outward from the bottom of the annular groove by the overpressure in the container interior, so that after further unscrewing of the closure lid, the aforementioned champagne cork effect occurs from a sudden pressure relief. The aforementioned prior art avoids this phenomenon by providing that the annular rib toward the lid has pressure relief conduits, which connect the annular groove with the pressure relief chamber, or are open toward the side of the annular rib remote from the groove, whenever the sealing ring has been lifted from the bottom of the annular groove. Although this does substantially prevent the aforementioned champagne cork effect, nevertheless, because the overpressure is only partly reduced, a residual pressure in the container remains, which especially upon very fast release or unscrewing of the closure lid can still cause the closure lid to jump off suddenly, even if only slightly.

SUMMARY OF THE INVENTION

The object of the present invention is therefore to embody a closure lid for the container neck of a container closure, and a container closure itself, each of the type defined at the outset, in such a way that the champagne cork effect caused by the sealing ring's lifting radially away from the groove bottom is averted in advance, thus achieving pressure relief of the container interior before the open position of the closure lid is reached.

For attaining this object, in a closure lid for the container neck of a container closure, the annular rib toward the outer part is provided with an uneven contact face for the sealing ring, and for a container closure, the same configuration of the annular rib is provided.

By the provisions of the invention, it is attained that whenever the sealing ring comes free of the sealing face of the container neck and gets into the neck enlargement, the sealing ring can either escape in the axial direction, upon subjection of certain regions of its annular circumference to the overpressure prevailing in the container interior, so that the sealing ring deforms axially asymmetrically, or the sealing ring is already deformed in the axial direction because of the design of the annular groove boundary, so that at these circumferential regions it more likely enters the range of the neck enlargement, thus partly and in advance opening up a venting route. This axial deformation, or deformed condition, of the sealing ring not only creates an advance venting route but also prevents the sealing ring from lifting radially outward from the bottom of the annular groove, so that the champagne cork effect phenomenon cannot even arise in the first place. In this way, a total pressure equalization can be achieved even at a relatively high overpressure in the container interior, before the closure lid has reached its fully open position.

In a preferred embodiment, the annular rib toward the container is provided with an uneven contact face for the sealing ring, as a result of which a suitably deformed installation position is already predetermined for the sealing ring. This leads to the further advantage of reduced frictional resistance as the closure lid is screwed in onto the container neck or is unscrewed and released from it.

In preferred features, the sealing ring contact face of the annular rib toward the outer part and/or of the annular rib toward the container is provided with one or more support ribs that protrude into the annular groove and are distributed over the circumference. The support rib can be disposed or embodied to be offset at angles from one another relative to the support rib of the annular rib toward the container, and/or each annular rib has a pair of diametrically opposed support ribs, and the two pairs are offset from one another by 90°, and/or the support ribs protrude axially from the contact face and have a radial length corresponding to the width of the annular rib. In normal operation, the support ribs bring about a linear support of the sealing ring inside the annular groove and can either fix the sealing ring in deformed fashion or, upon overpressure in the container interior, during the unscrewing motion of the closure lid, they can allow an adequate axial motion of the sealing ring between adjacent support ribs.

A further embodiment is defined in that the sealing ring contact face of the annular rib toward the outer part is provided with at least one axial recess which extends radially from the circumferential edge of the annular rib, and in combination with them optionally the recess is provided at two diametrically opposed points and/or has an inner boundary line that is embodied as convexly swooping.

A further embodiment is obtained by the recess having a crescent-shaped bottom face, and in an embodiment optionally the crescent-shaped bottom face extends over the entire circumference of the annular rib toward the outer part and over that course varies its radial width constantly from a width corresponding to the width of the annular rib down to zero, and/or an uneven contact face for the sealing ring is provided on an annular rib toward the container that additionally defines the annular groove.

In these last two embodiments, wherein the groove bottom of the annular groove, in a widening of the contact face, has an encompassing groove the axial mobility or predeformed fixation of the sealing ring is provided by means of variously designed recesses or indentations in the annular rib contact face or faces.

BRIEF DESCRIPTION OF THE DRAWINGS

Further details of the invention can be learned from the ensuing description, in which the invention is described and explained in further detail in terms of the exemplary embodiments shown in the drawing.

DESCRIPTION OF THE PREFERRED EMBODIMENTS

Figure 1:
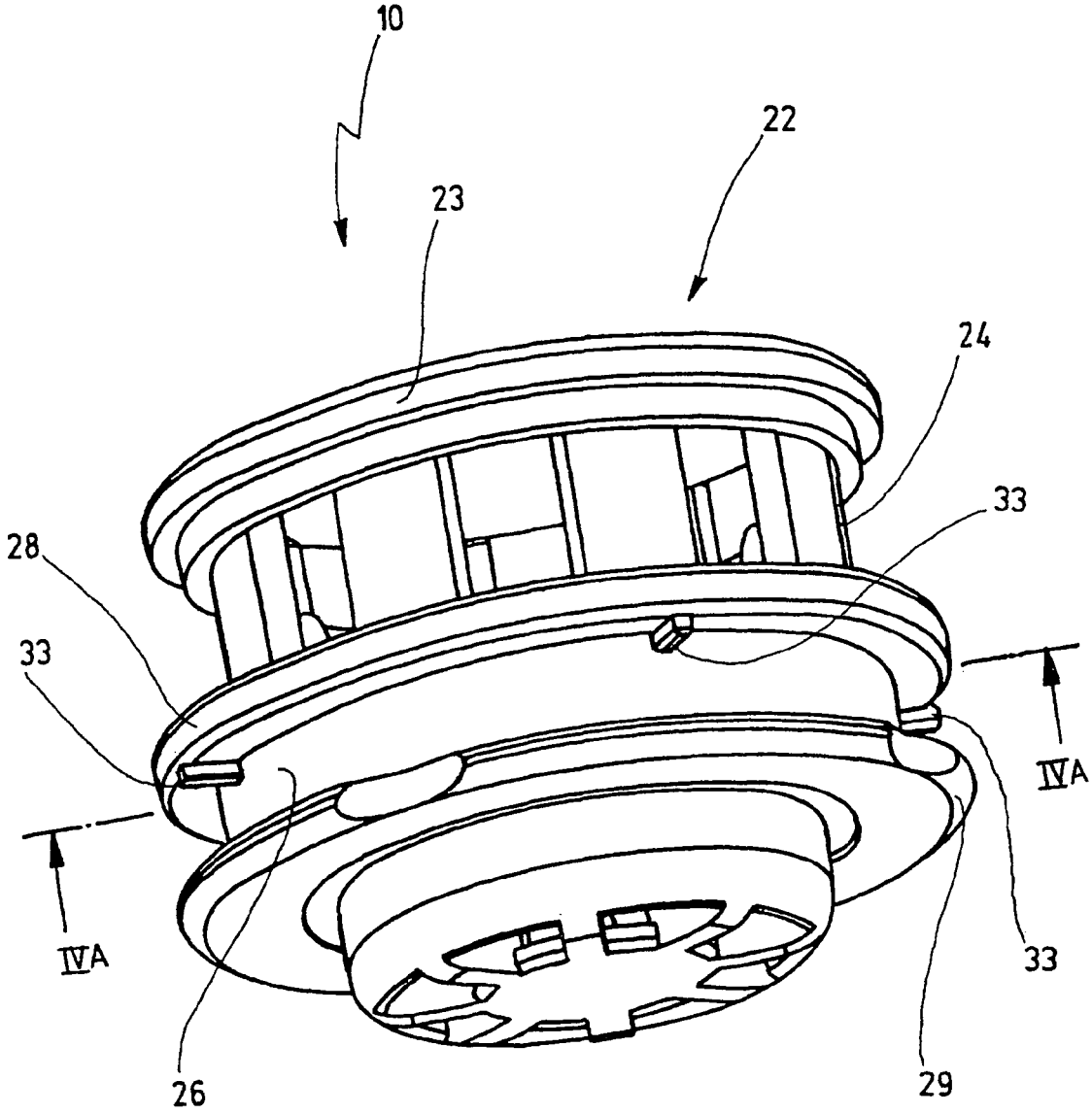
FIG. 1, is a schematic perspective view, the inner part of a closure lid for the container neck of a container closure, in a first exemplary embodiment of the present invention.
Figure 2:
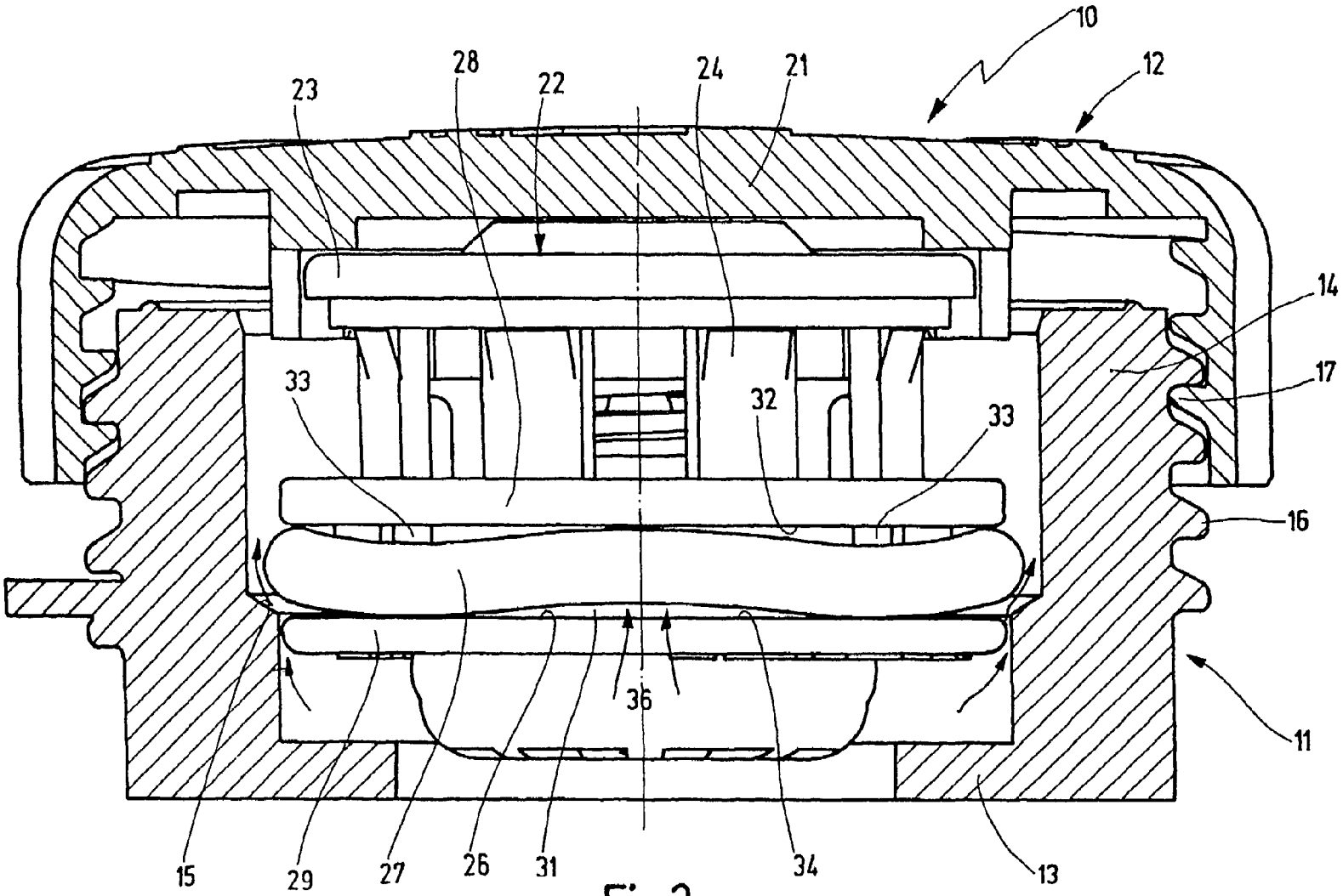
FIG. 2, is a schematic longitudinal section, a container closure of a closure lid, placed in a container neck, of FIG. 1 showing the status while the closure lid is being unscrewed from the container neck.
Figure 3:
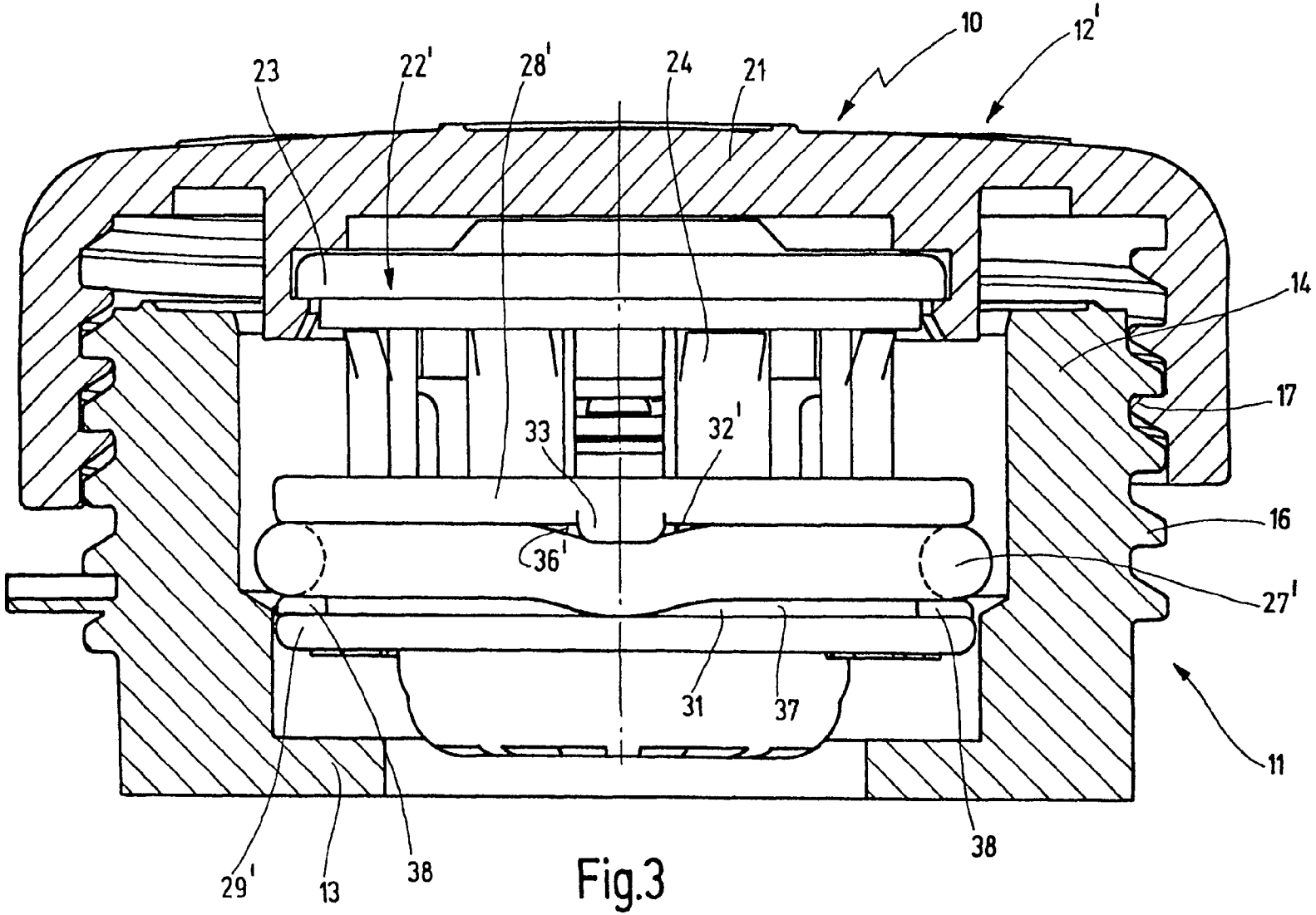
FIG. 3, is a view corresponding to FIG. 2, but in a second exemplary embodiment of the present invention.

FIGS. 1 and 2, and the one hand, and FIG. 3 on the other, show two embodiments, each with a container closure 10 embodied essentially rotationally symmetrically, which has a container neck 11 and a closure lid 12 or 12' screwed onto the container neck.

The container neck 11 on the bottom has a narrowed neck portion 13, which is in communication with an opening in a container, not shown, preferably a radiator for internal combustion engines. An enlarged neck portion 14 is provided in the upper region of the container neck 11 and is joined to the lower neck portion 13 via a conical intermediate portion (ramp) 15. The container neck 11 is provided with a male thread 16, by way of which the closure lid 12, 12' can be screwed to a female thread 17, or in other words can be screwed on and unscrewed.

The closure lid 12 and 12' has a caplike outer part 21, which fits over the container neck 11 and which is provided with the female thread 17 for screwing onto and unscrewing from the container neck 11. The closure lid 12, 12' also has a cup-shaped inner part 22, which is shown in perspective in FIG. 1, and an inner part 22', respectively. The inner part 22, 22' is inserted lockingly with an upper edge 23 into an inner groove on the outer part 21, so that the outer part 21 and the inner part 22, 22' can rotate relative to one another. In the lower region, the basket part 24 provided with the upper edge 23 is adjoined by an annular groove 26, into which an elastomeric sealing ring 27 in the form of an O-ring is inserted. The annular groove 26, 26' is defined on one side by an annular rib 28, 28' toward the outer part and by an annular rib 29, 29' pointing toward the container. The outer diameter of the annular ribs 28, 28' and 29, 29' is less than the outer diameter of the sealing ring 27 that rests with radially inward-oriented prestressing on the groove bottom 31 of the annular groove 26, 26'.

In the first exemplary embodiment, shown in FIGS. 1 and 2, the annular rib 28 toward the outer part is provided, on its contact face 32, with support ribs 33 that protrude axially in the direction of the annular rib 29 toward the container interior. The length of the support ribs 33 is equivalent to the radial width of the contact face 32 of the annular rib 28 toward the outer part. The support ribs 33 are very narrow in the circumferential direction and have a likewise relatively slight axial height; in the exemplary embodiment, this axial height is determined such that the inside diameter between the support rib 33 and the opposite face 34 of the annular rib 29 toward the container interior is approximately equal to the thickness of the O-ring 27. In the exemplary embodiment shown, four support ribs 33 are provided, distributed uniformly over the circumference of the contact face 32 of the annular rib 28 toward the outer part.

In the second exemplary embodiment shown in FIG. 3, not only is the annular rib 28' toward the outer part provided on its contact face 32', but the annular rib 29 toward the container is also provided on its contact face 37 with axially protruding support ribs 33 and 38, respectively. Each annular rib 28', 29' has a pair of diametrically opposed support ribs 33 and 38, respectively, which are oriented axially toward one another or in other words protrude into the annular groove 26. The pairs of support ribs 33 and 38 are offset from one another by 90°. Thus the sealing ring 27' rests in deformed form in the annular groove 26'. Since the height of the support ribs 33 and 38 is such that the inside diameter, between each support rib 33 and 38 and the opposite face 37 of the annular rib 29' toward the container interior and between the support ribs 38 and the opposite face 32' of the annular rib 28' toward the outer part, is approximately equal to the thickness of the O-ring 27, the sealing ring 27' is fixed in the annular groove 26' with a suitable deformation that is undulating in the circumferential direction. The length of the support ribs 33 and 38 corresponds to that of the support ribs 33 in the first exemplary embodiment.

In a completely closed position, not shown, of the closure lid 12, 12' or inner part 22, 22' in the container neck 11, the annular sealing face of the lower neck portion 13 of the container neck 11 is located facing the annular groove 26 and thus the sealing ring 27, 27', so that this ring rests sealingly in the lower neck portion 13 of the container neck 11. Thus the sealing ring 27, 27' is deformed such that it is compressed into an oval.

If now, as shown in FIG. 2, the closure lid 12 is unscrewed from the container neck 11, then the sealing ring 27 reaches the region of the conical or ramplike portion 15 of the inside circumference of the container neck 11, so that the compression of the sealing ring 27 is reduced. Because of the overpressure that prevails as before in the container interior, the sealing ring 27 is now moved axially inside the annular groove 26, specifically into the regions that are located between the support ribs 33. Because of this uneven contact face 32 of the annular rib 28 toward the outer part, the axial motion of some regions of the sealing face 27 produces an asymmetrical deformation, so that as FIG. 2 shows, a connecting path 36 that bypasses the ramp portion 15 and extends into the neck enlargement and is thus a venting route is created in the deformed portions of the sealing ring 27, before the entire sealing ring 27 gets into the neck enlargement or the upper neck portion 14. Since the asymmetrical deformation of the sealing ring 27 creates an advance venting route that causes a pressure reduction, the phenomenon of blasting the sealing ring 27 from behind, and thus its lifting from the groove bottom 31, is avoided.

If as shown in FIG. 3 the closure lid 12' is unscrewed from the container neck 11, then once again the sealing ring 27' gets into the region of the conical or ramplike portion 15 of the inside circumference of the container neck 11, thus lessening the compression of the sealing ring 27'. Since the sealing ring 27' inside the annular groove 26' is predeformed such that it is undulating in the circumferential direction between the two uneven contact faces 32' and 34 of the two annular ribs 28' and 29', the result, as shown in FIG. 3, in the deformed portions of the sealing ring 27' upon loosening of the closure lid 12' is a connecting path 36' that bypasses the ramp portion 15 and extends into the neck enlargement and thus readily creates a venting route, before the entire sealing ring 27' reaches the neck enlargement or the upper neck portion 14. This venting route 36' is the result of this asymmetrical deformation of the sealing ring 27', particularly in the region of the support ribs 33 of the annular rib 28' toward the outer part. Once again, the phenomenon of blasting of the sealing ring 27' from behind and thus its possible lifting from the groove bottom 31 is avoided because of the pressure reduction that automatically occurs.

Thus a pressure relief of the closure lid 12, 12' is achieved and completed during the unscrewing of the closure lid, before the closure lid 12, 12' with its female thread 17 comes completely free of the male thread 16.

Figure 4A:
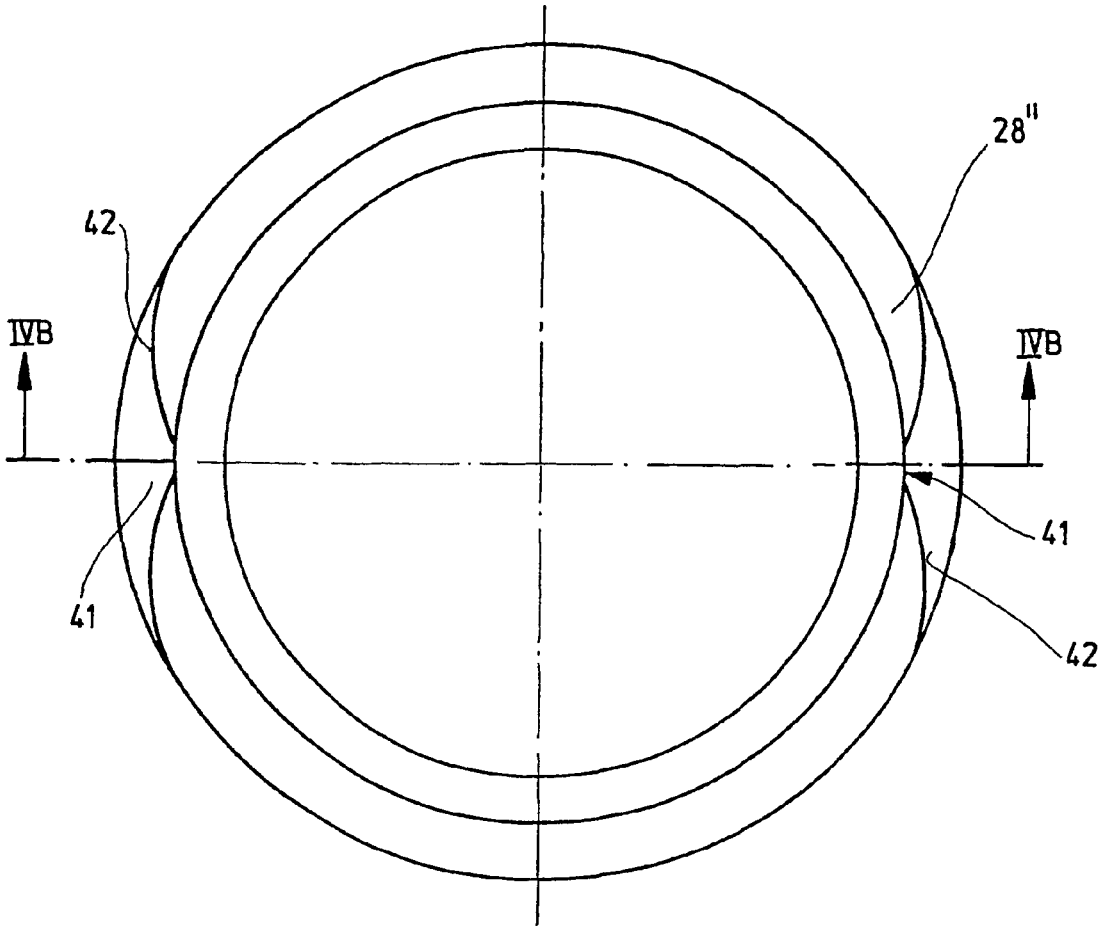
FIGS. 4A and 4B, are a section taken along the line IVA-IVA of FIG. 1 and a section taken along the line IVB-IVB of FIG. 4A, for a third exemplary embodiment of the present invention.
Figure 4B:
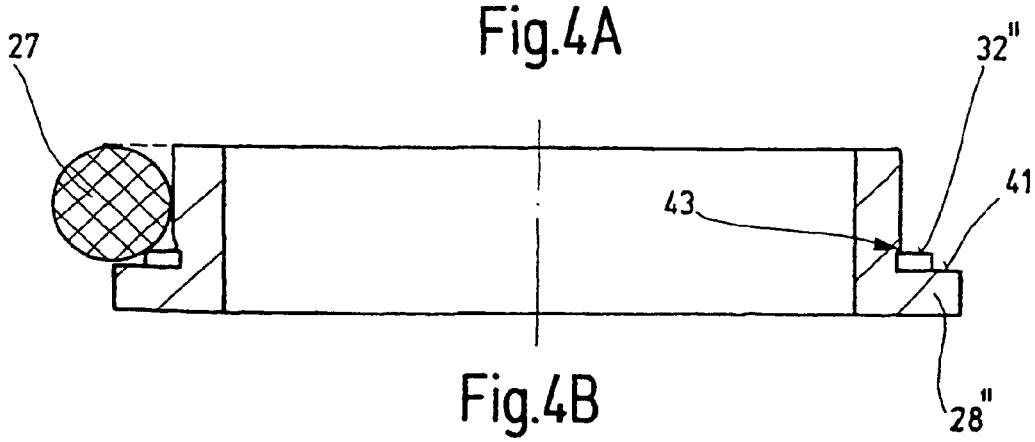

FIGS. 4A and 4B show one embodiment of an uneven contact face 32" of the annular rib 28" toward the outer part, such that two diametrically opposed recesses 41 are formed in the contact face 32". The two identically mirror-symmetrical recesses 41 have swooping convexly embodied boundary lines 42. This means that in the region of these recesses 41, as the closure lid 12" is being loosened from the container neck 11, the sealing ring 27 can deform axially asymmetrically in the region of these recesses 41, so that in these regions a pressure relief path is created during the unscrewing motion. For collecting the air or water vapor blown out during the pressure relief, an encompassing groove 43 is provided in the region of the groove bottom and adjacent to the contact face 32".

Figure 5A:
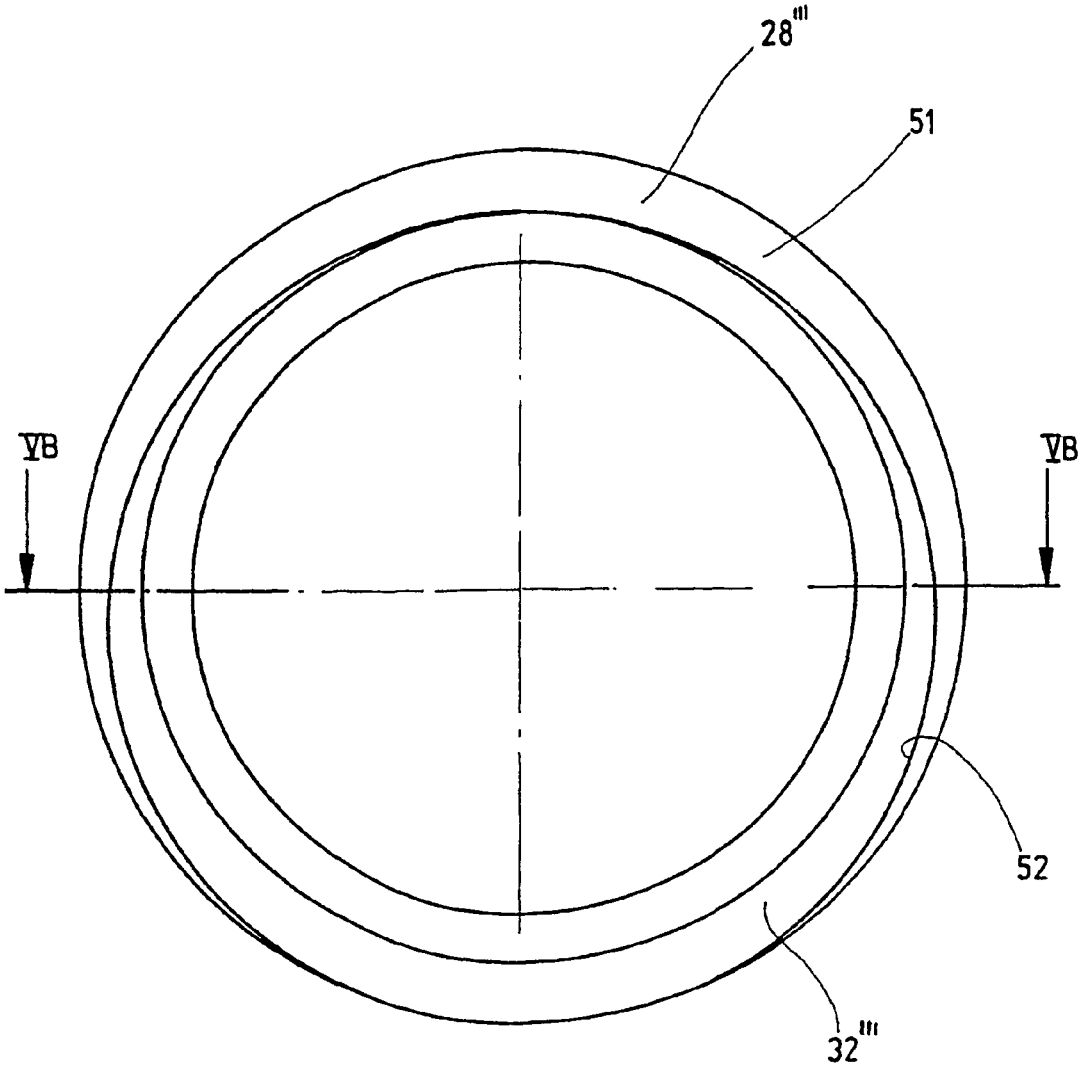
FIGS. 5A and 5B, are views corresponding to FIGS. 4A and 4B, but for a fourth exemplary embodiment of the present invention.
Figure 5B:
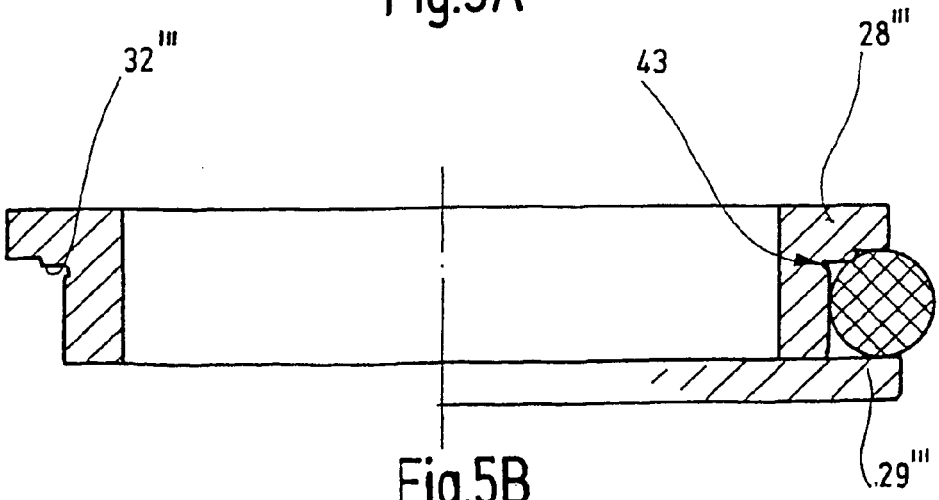

FIGS. 5A and 5B show a further exemplary embodiment of an uneven contact face 32'", in which this contact face is likewise provided with a recess 51, which like the recess 41 of FIGS. 4A and 4B extends radially inward from the outer circumference of the respective contact face 32" and 32'". The depth of each recess 41 and 51 is relatively slight. In this exemplary embodiment, the recess 51 is embodied as somewhat crescent-shaped, as viewed in plan view; the spacing of the circular inner boundary line 52 from the outer circumferential edge of the contact face 32'" decreases symmetrically. In one region, the spacing between the boundary line 52 and the outer circumference of the contact face 32'" is at maximum equal to the radial width of the contact face 32'", while in the diametrically opposed region, it is equal to zero. In other words, the boundary line 52 extends in a circle, and the circle of the boundary line 52 extends correspondingly eccentrically to the circle of the outer circumference of the contact face 32'". In this exemplary embodiment as well, a collection groove 53 is provided for the water vapor or air to be blown away. In this exemplary embodiment, the axial deformation of the sealing ring 27 is achieved in the region of the crescent-shaped recess 51.

The invention claimed is:

1. A closure lid for the container neck of a container closure, having:

an outer part;

an inner part retained on said outer part; and a sealing ring, wherein:

said inner part having an outer circumference with an annular rib partly defining an annular groove;

said sealing ring being inserted in said annular groove;

said annular rib, toward its outer part, is provided with an uneven contact face for said sealing ring;

said inner part has a further annular rib with a contact face;

said uneven contact face of said annular rib and/or said contact face of said further annular rib are provided with one or more support ribs that protrude into said annular groove and are distributed over the circumference thereof; and said support ribs of said annular rib are offset at angles from one another relative to said support ribs of said further annular rib.

2. The closure lid of claim 1, wherein:

said further annular rib and said annular rib both define said annular groove; and said further annular rib, toward the container, defines an uneven contact face for said sealing ring.

3. The closure lid of claim 1, wherein:

said annular rib and said further annular rib each has a pair of diametrically opposed ones of said support ribs, and the two pairs are offset from one another by 90°.

4. The closure lid of claim 1, wherein:

said support ribs of said further annular rib which protrude axially from said contact face of said further annular rib have a radial length corresponding to the width of said annular rib.

5. The closure lid of claim 1, wherein:

said contact face of said annular rib is provided with at least one axial recess which extends radially from the circumferential edge of said annular rib.

6. The closure lid of claim 5, wherein:

said at least one axial recess is provided at two diametrically opposed points.

7. The closure lid of claim 5, wherein:

said at least one axial recess has an inner boundary line that is embodied as convexly swooping.

8. The closure lid of claim 5, wherein:

said at least one axial recess has a crescent-shaped bottom face.

9. The closure lid of claim 8, wherein:

said crescent-shaped bottom face extends over the entire circumference of said annular rib, and over this course varies its radial width constantly from a width corresponding to the width of said annular rib to zero.

10. The closure lid of claim 5, wherein:

said further annular rib defines an uneven contact face for said sealing ring, said uneven contact face of said further annular rib partially defines said annular groove.

11. The closure lid of claim 5, wherein:

the groove bottom of said annular groove defines an encompassing groove in the widening of said uneven contact face of said annular rib.

* * * * *